US006457969B1

(12) United States Patent
Khosla

(10) Patent No.: US 6,457,969 B1
(45) Date of Patent: Oct. 1, 2002

(54) CANDLE TIN

(75) Inventor: Jivan Kumar Khosla, Newtown, PA (US)

(73) Assignee: United States Can Company, Lombard, IL (US)

( * ) Notice: Subject to any disclaimer, the term of this patent is extended or adjusted under 35 U.S.C. 154(b) by 0 days.

(21) Appl. No.: 09/642,700

(22) Filed: Aug. 9, 2000

(51) Int. Cl.[7] ..... F21V 35/00
(52) U.S. Cl. ..... 431/291; 220/212
(58) Field of Search ..... 431/289, 291; 422/125, 126; 126/43, 45; 220/212

(56) References Cited

U.S. PATENT DOCUMENTS 1,226,625 A * 5/1917 Ball ..... 126/43
3,581,932 A 6/1971 Kreeger
3,583,853 A 6/1971 Schramm
3,967,731 A 7/1976 Boduch
5,879,151 A * 3/1999 Schultz et al. ..... 431/291
6,155,451 A * 12/2000 Pietruch et al. ..... 220/608
6,171,102 B1 * 1/2001 Freeman et al. ..... 431/291

* cited by examiner

*Primary Examiner*—Sara Clarke
(74) *Attorney, Agent, or Firm*—Polster, Lieder, Woodruff & Lucchesi, L.C.

(57) ABSTRACT

A candle tin (10) includes a cup shaped holder (12) in which a candle (14) is placed. A cover or cap (20) fits over the top of the tin. The cover is readily removable and when removed is used as a base upon which the candle tin rests. The tin nests in the cover or rests upon the cover depending upon the particular cover construction. When the holder is set upon the cover, a gap between the cover an holder allows air to freely circulate about the tin to dispel heat generated by the candle's burning. Also, the cover provides a heat sink which absorbs heat from the holder created by the burning candle. This keeps a surface upon which the candle tin is placed from scorching and being discolored due to the heat. Various constructions of the cover and holder are disclosed by which the holder nests in or fits on the cover.

7 Claims, 6 Drawing Sheets

CANDLE TIN

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to candle holders, and more particularly, to a candle tin having a removable cover which further acts as a base for the candle tin.

Candle tins comprise a cup shaped holder in which a candle wax is poured about a wick material to form a candle. Currently, the tins are made of a sheet metal. As the candle burns, the sheet metal gets hot. This is particularly so when the candle nears the bottom of the tin as it burns out. Unless the tin is placed on a tile or other heat resistant material, the surface upon which the tin is set will be damaged by the heat. Wooden and painted surfaces are particularly susceptible to heat damage; although other type surfaces can be damaged as well.

BRIEF SUMMARY OF THE INVENTION

Among the several objects of the present invention may be noted the provision of a candle tin having a removable cover which is used as a base for the tin so to prevent heat generated by the burning candle to scorch a surface on which the tin is set;

- the provision of such a candle tin in which the cover, when used as a base allows air circulation around and beneath the tin so to dissipate heat created by the candle burning;
- the provision of such a candle tin which nests in the cover when the cover is used as a base;
- the provision of such a candle tin in which the cover, in one embodiment is perforated about its circumference to further facilitate air flow about the candle tin and heat dissipation;
- the provision of such a candle tin in which the cover is inverted for use as the base, the side of the cover abutting the underside of the tin has a projection formed thereon, and the bottom of the tin has a recess formed therein conforming in size and shape to that of the projection so to facilitate setting the tin on the base; and,
- the provision of such a candle tin which is decorative and functional, and which provides an attractive, low cost adornment to a room.

In accordance with the invention, generally stated, a candle tin includes a cup shaped generally circular or rectangular holder in which a candle is placed. A cover or cap fits over the top of the tin. The cover is readily removable and when removed is used as a base upon which the candle tin rests. The tin nests in the cover which is formed so that air freely circulates about the tin to dispel heat generated by the candle's burning. This keeps the surface upon which the candle tin is placed from scorching and being discolored due to the heat. Other objects and features will be in part apparent and in part pointed out hereinafter.

BRIEF DESCRIPTION OF THE SEVERAL VIEWS OF THE DRAWINGS

In the drawings, FIGS. 1A–1C illustrate a first embodiment of a candle tin of the present invention in which FIG. 1A illustrates the candle tin with a cover in place, FIG. 1B the candle tin with the cover removed and used as a base, and FIG. 1C an enlarged view of a portion of the tin illustrating how the candle tin rests upon the cover;

Corresponding reference characters indicate corresponding parts throughout the drawings.

DETAILED DESCRIPTION OF THE INVENTION

Figure 1A:
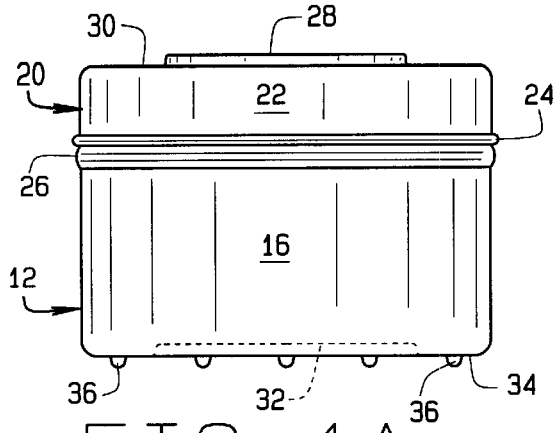

Referring to the drawings, a candle tin of the present invention is indicated generally 10 in FIG. 1A. The candle tin includes a hollow, cup shaped base 12 which is shown in FIG. 1A as being generally round; although the base can also be generally rectangular, star shaped, or another preferred shape. A candle 14 is fitted into a space defined by a sidewall 16 of the base and a wick 18 protrudes outwardly from the top of the candle. The candle can be placed in the base, or formed in the base by pouring candle wax into the base.

The candle tin further includes a cover 20 which fits over the top of base 12. Cover 20 covers the open end of base 12 when the candle is not lit, and is removed prior to lighting the candle. The cover is slightly larger in size than the base for a sidewall 22 of the cover to slide over sidewall 16 of the base to enclose the candle. The diameter of cover 20 is uniform throughout the height of the cover. The lower end of cover 20 has a circumferentially extending, upturned or curled edge 24. A rib 26 is sometimes formed on base 12 and extends circumferentially about the base a distance d below the top of the base. Distance d generally corresponds to the height of cover 20 so lower edge 24 of the cover fits against the upper portion of rib 26 when the cover is in place.

Figure 1D:
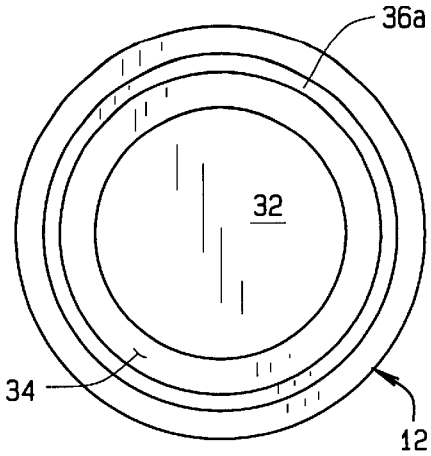
FIGS. 1D–1F illustrate various constructions of a foot formed in a bottom surface of the candle tin.
Figure 1B:
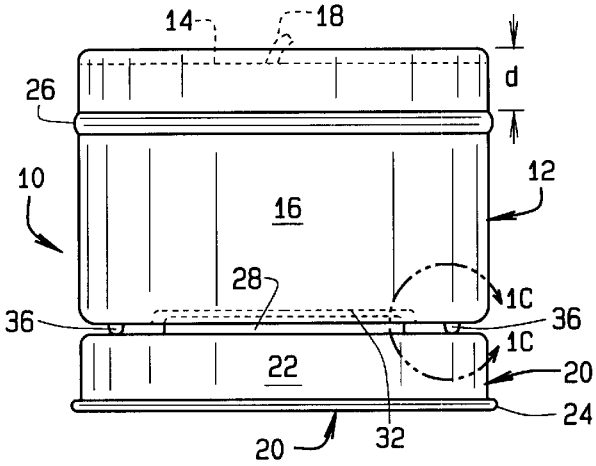
Figure 1E:
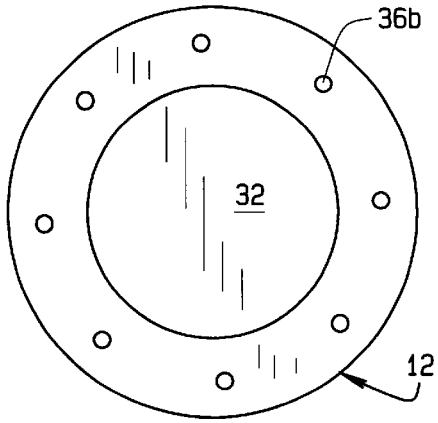
Figure 1C:
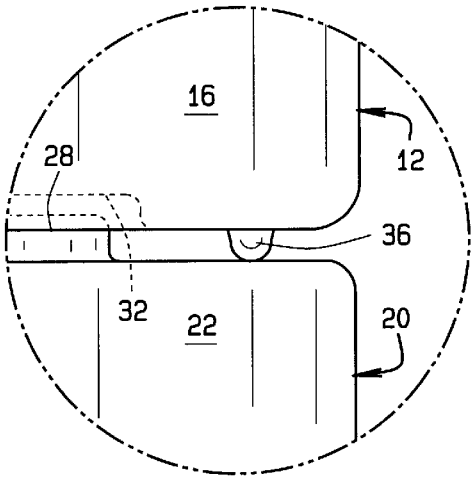
Figure 1F:
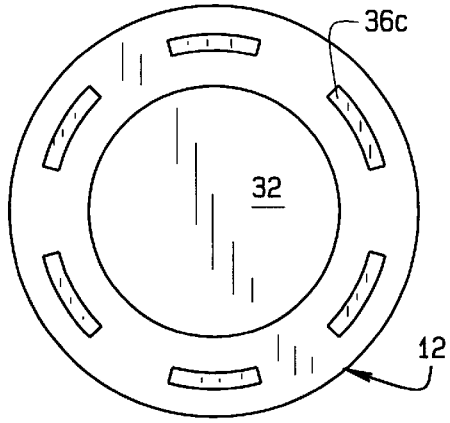

Cover 20 has a circular projection 28 formed in its upper end 30. A correspondingly sized recess 32 is formed in a bottom surface 34 of base 12. Radially outwardly of this recess are circumferentially extending protrusions such as feet 36 which project or extend from bottom surface 34. As shown in FIGS. 1D–1F, the feet can comprise a continuous foot 36*a* (FIG. 1D); or they may comprise a series of spaced feet each of which is either conical in shape 36*b* (FIG. 1E), or subtends a small arc 36*c* (FIG. 1F). Regardless, the foot or feet rest upon a surface on which the candle tin is set. As previously noted, when the candle burns, the base of the candle tin gets hot and the heat transferred through the base and feet can burn or scorch the surface. In accordance with the invention, cover 20, once removed from the candle tin, is used as the base for the unit. This is as shown in FIG. 1B. Lower edge 24 of the cover is placed on the surface, and the foot or feet 36 of base 12 are placed upon upper end 30 of the cover. Recess 32 of base 12 is placed over projection 28 on the top surface of the cover to center the base on the cover. An air gap is formed between the base and cover and air flow through the gap helps direct heat away from the candle tin. Further, the cover acts as a heat sink with regard to heat transferred from base 12 to the cover. Although heat is transferred from base 12 to the cover, the amount of heat is small and any temperature to which cover 20 is elevated is much less than that which would cause damage to the surface on which the candle tin is placed.

Figure 2A:
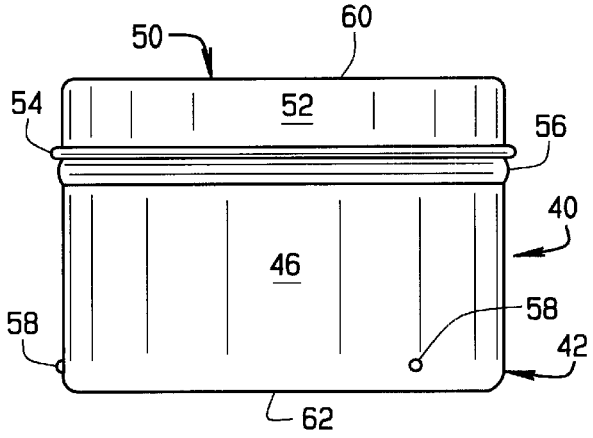
FIGS. 2A–2C are similar views for a second embodiment of the candle tin.
Figure 2B:
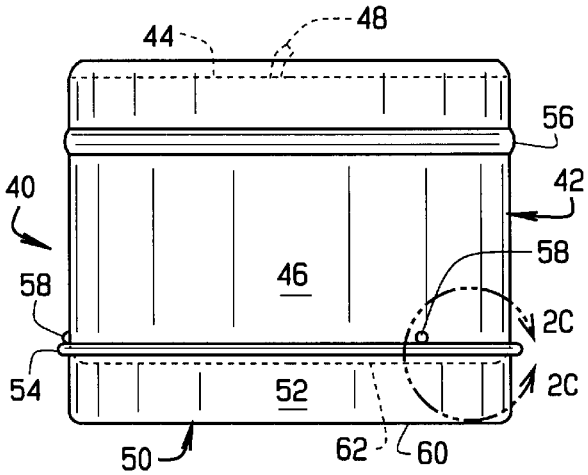
Figure 2C:
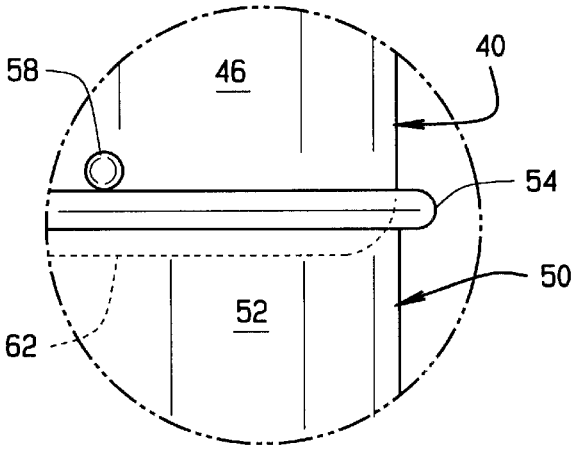

Referring to FIGS. 2A–2C, a second embodiment of the candle tin of the present invention is indicated generally 40. Again, the candle tin includes a hollow, cup shaped base 42 in which a candle 44 fits into the space defined by a sidewall 46 of the base. A wick 48 protrudes outwardly from the top of the candle. A cover 50 fits over the top of base 42, the cover being slightly larger in size than the base for a sidewall 52 of the cover to fit over sidewall 46 of the base and enclose candle 44. Again, the diameter of the sidewall is uniform throughout the height of the cover. The lower end of cover 50 has a circumferentially extending, upturned or curled edge 54. A rib (optional) 56 formed on base 42 extends circumferentially about the base a distance generally corresponding to the height of cover 50 so lower edge 54 of the cover fits against the upper portion of rib 56 when the cover is in place.

Base 42 has a plurality of spaced bosses 58 projecting outwardly from the lower extent of sidewall 46. The number and spacing of these bosses may vary. In the embodiment of FIGS. 2A–2C, there are three bosses (only two of which are shown in the drawings) located 120° apart.

Again in accordance with the invention, cover 50, once removed from the candle tin, provides a base for the unit. This is as shown in FIG. 2B. Whereas in the previous embodiment, the lower edge of the cover was placed on the surface and the feet or foot portion of the base rested upon the top surface of the cover; now, cover 50 is inverted so its top surface 60 rests upon the surface on which the candle tin is set. The bottom surface 62 of base 42 is now lowered into the cavity formed by cover 50 until the bosses 58 bear against edge 54 of the cover. With a three or more point contact between the base and cover, the resulting unit is stable and will not tip. As shown in FIG. 2C, an air gap is again formed between the base and cover and air flow through the gap helps direct heat away from the candle tin. Heat is transferred from base 42 to cover 50, but the base provides such a large heat sink, that the temperature of the cover will rise only slightly, and not enough to damage a surface on which the candle tin is placed.

Figure 3A:
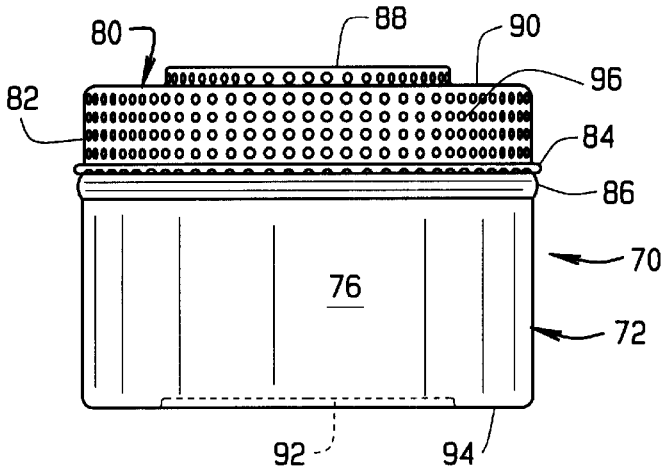
FIGS. 3A–3C are similar views for a third embodiment of the candle tin in which the cover in perforated.
Figure 3B:
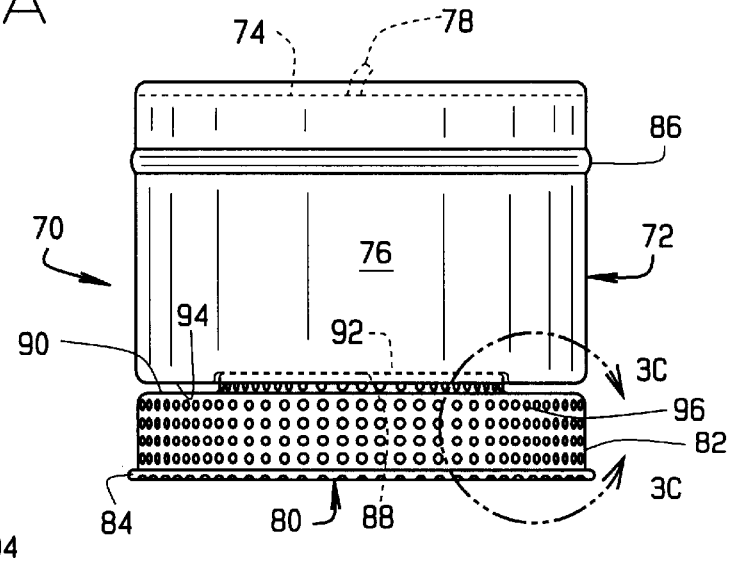
Figure 3C:
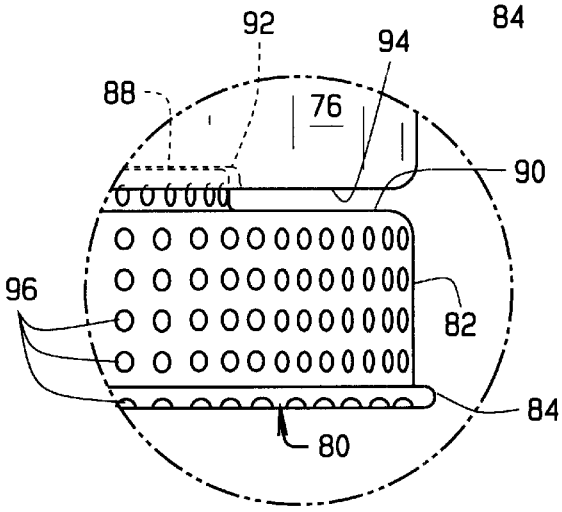

Referring to FIGS. 3A–3C, a candle tin embodiment similar to that first described is shown. This embodiment is indicated generally 70 and includes a cup shaped base 72 in which a candle 74 is fitted into the space defined by a sidewall 76 of the base with a wick 78 protruding outwardly from the top of the candle. As with the first described embodiment, a cover 80 fits over the top of base 72, the cover having a sidewall 82 and an upturned curled edge 84 which fits against the upper portion of a rib 86 on the base when the cover is in place.

Cover 80 has a circular projection 88 formed in its upper end 90, and a correspondingly sized recess 92 is formed in a bottom surface 94 of base 72. Accordingly, when the cover is removed and set on a surface, base 72 nests on the cover with recess 92 fitting onto projection 88 of the cover. Cover 80 has a plurality of perforations 96 formed in it, the perforations being formed in circular bands extending about the cover, including the curled edge portion of the cover. These perforations allow air to freely flow through the cover and convey heat from the candle tin away from the cover, again preventing scorching of the surface.

Figure 4A:
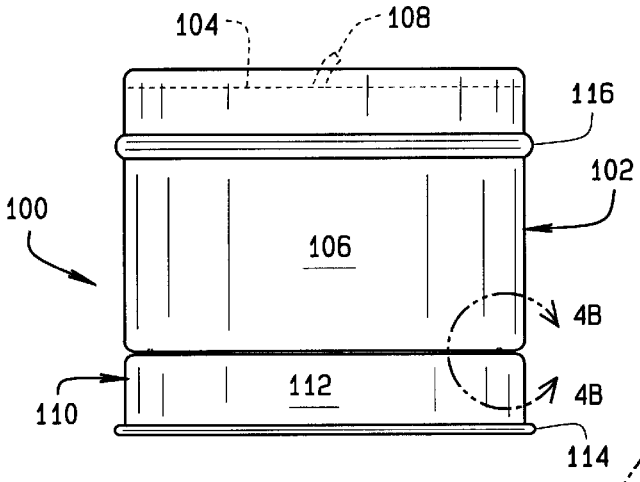
FIG. 4A illustrates another embodiment of the candle tin in which the cover is removed and used as a base.
Figure 4B:
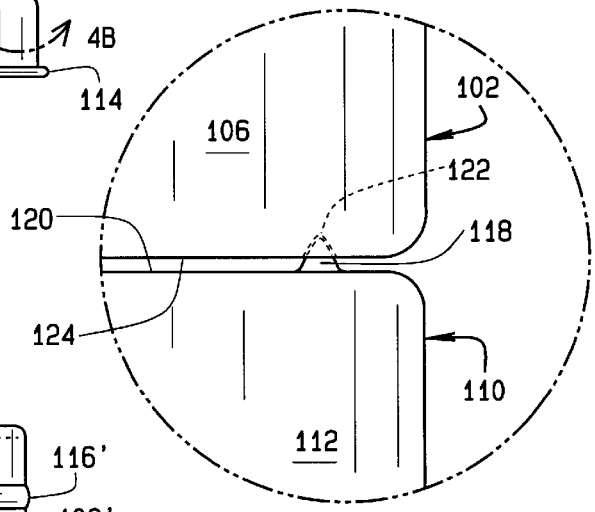
FIG. 4B is an enlarged view of a portion of the tin illustrating how the tin rests upon the cover.

In FIGS. 4A and 4B, an embodiment 100 of the candle tin includes a base 102 with a candle 104 fitted in the space defined by a sidewall 106 of the base. A wick 108 protrudes outwardly from the top of the candle. A cover 110 which fits over the top of base 102 is shown in FIG. 4A positioned beneath the base. A cover sidewall 112 fits over sidewall 106 of the base to enclose the candle and a curled lower edge 114 of the cover bears against a rib 116 of base 102 when the cover is placed over the base. When used as shown in FIG. 4A, edge 114 of the cover rests on the surface upon which the candle tin is set. Upwardly projecting nibs 118 extend from a top surface 120 of cover 110. Indentations 122 are formed in the bottom 124 of base 102 and the base is oriented so the nibs fit into these indentations to form a stable platform for the candle tin. There are a series of these spaced nibs, preferably three spaced equidistantly apart from each other. As with the other embodiments, the height of the nibs creates an air gap between the base and cover so to reduce the amount of heat transfer to the cover and prevent scorching the surface on which the candle tin rests.

Figure 5A:
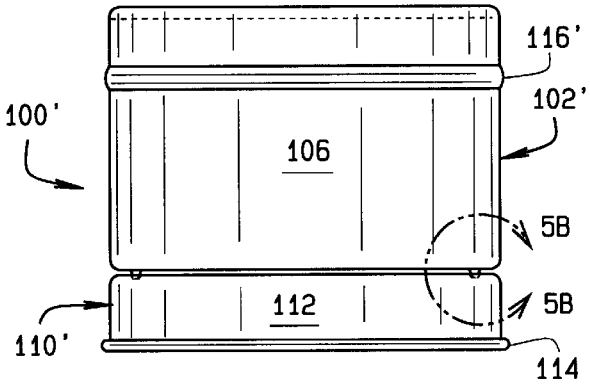
FIGS. 5A and 5B are views similar to those of FIGS. 4A and 4B for another embodiment of the candle tin.
Figure 5B:
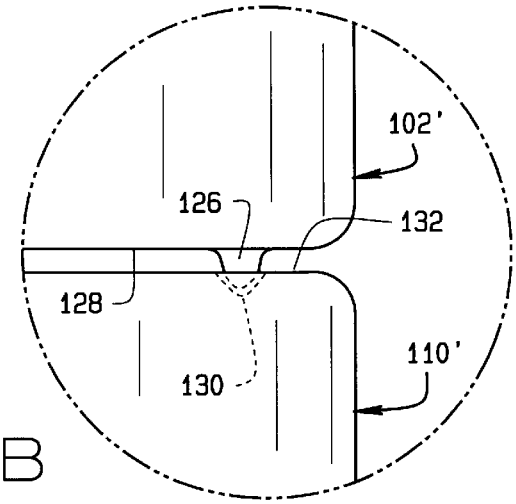

FIGS. 5A and 5B illustrate a variation indicated generally 100' of the just described embodiment 100 of the candle tin. Now, nibs or feet 126 extend from bottom surface 128 of base 102'. Indentations 130 are formed in top surface 132 of cover 110' and the feet are received in these indentations. Again there are preferably three feet 126 spaced equidistantly apart extending from surface 128 of base 102'. Also, as shown in FIG. 5B, the indentations are square not rounded such as the indentations 122 shown in FIG. 4B.

Figure 6A:
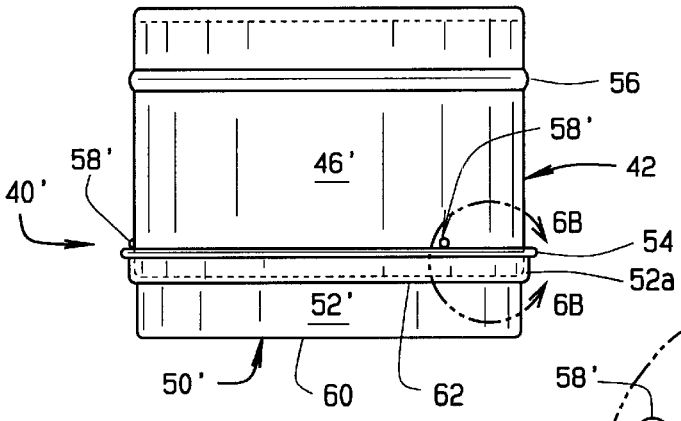
FIGS. 6A and 6B are views similar to those of FIGS. 2A–2C for another embodiment of the candle tin.
Figure 6B:
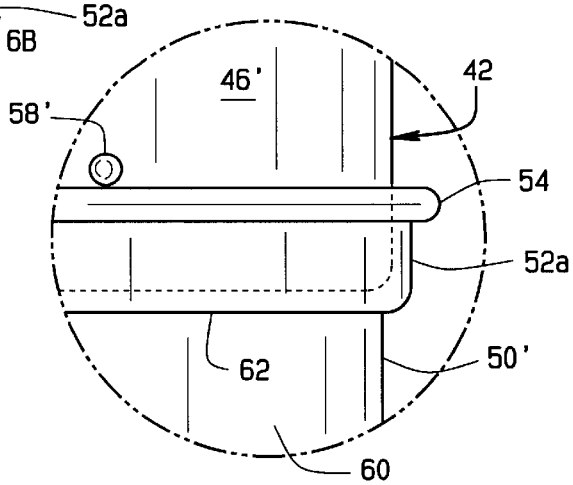

Similarly, FIGS. 6A and 6B illustrate a variation indicated generally 40' of the candle tin embodiment shown in FIGS. 2A–2C. Now, sidewall 52' of cover 50' is not uniform in diameter throughout the height of the cover as with the embodiment of FIGS. 2A–2C. Rather, cover 50' has a lower end section **52*a* which is greater in diameter than the upper portion of the sidewall. Bosses 58' protruding from sidewall 46' of candle tin base 46' bear against this lower end section of cover 50'** to seat the base onto the cover.

Figure 7A:
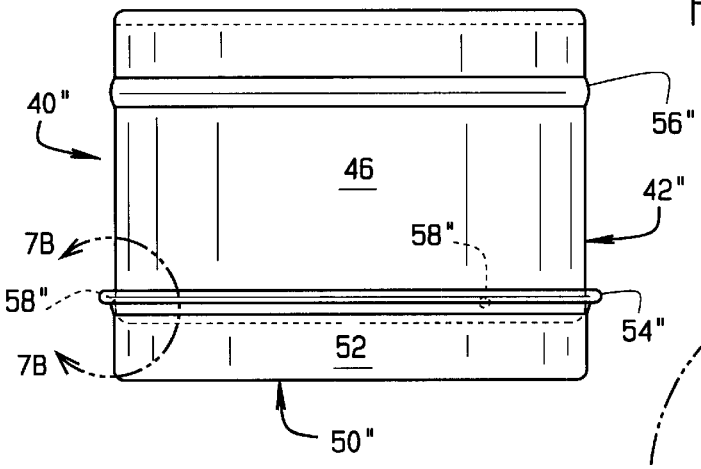
FIGS. 7A and 7B are views similar to those of FIGS. 4A and 4B for another embodiment of the candle tin; and, FIGS. 8A and 8B are views similar to those of FIGS. 4A and 4B for another embodiment of the candle tin.
Figure 7B:
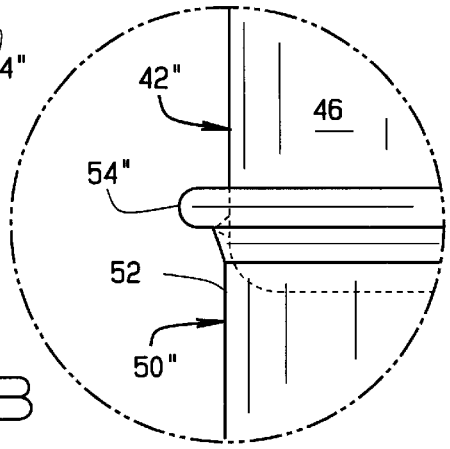

Another variation of the embodiment 40 is indicated generally 40" in FIGS. 7A and 7B. In this embodiment sidewall 52" of cover 50" is straightwalled from the top of the cover to immediately above edge 54" at the base of the cover. As best shown in FIG. 7B, the sidewall of the cover angles slightly outwardly immediately above edge 54" forming an angled or sloping surface against which a boss 58" protruding from the side of base 42" of the candle tin bears.

Figure 8A:
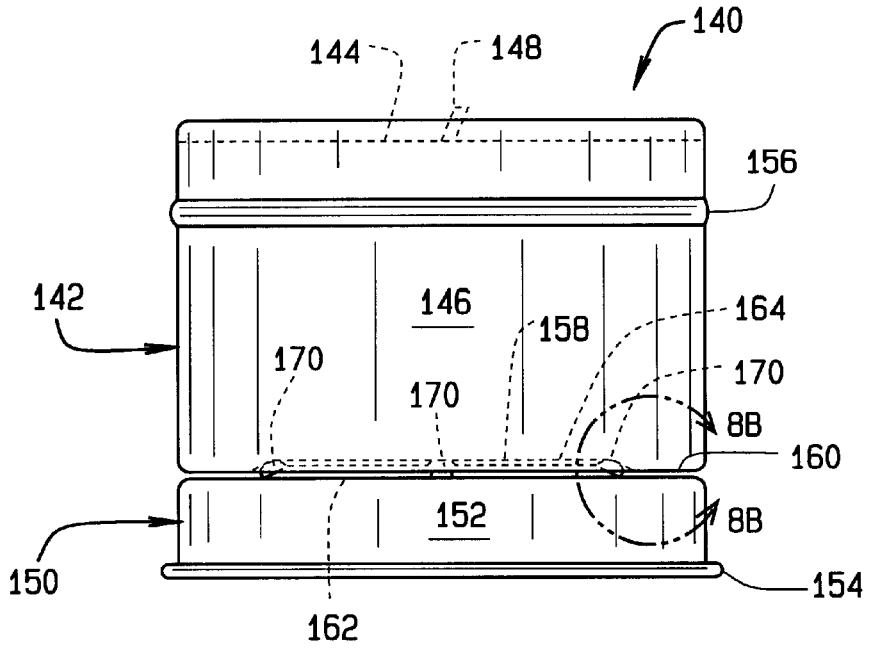
Figure 8B:
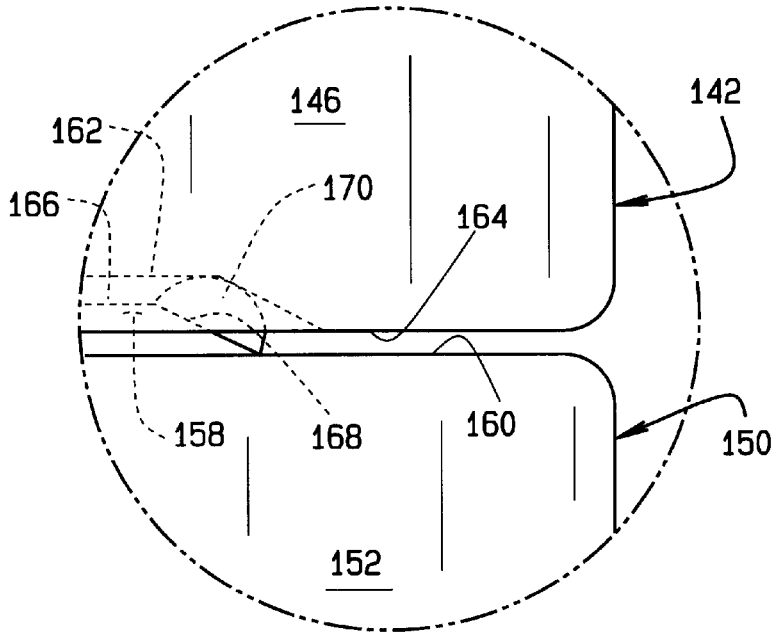

Finally, referring to FIGS. 8A and 8B, an embodiment of the candle tin indicated generally 140 in the drawings includes a cup shaped base 142 in which a candle 144 is fitted into the space defined by a sidewall 146 of the base with a wick 148 protruding outwardly from the top of the candle. A cover 150 fits over the top of base 142, the cover having a sidewall 152 and an upturned curled edge 154 which fits against the upper portion of a rib 156 on the base when the cover is in place. Cover 150 has a circular projection 158 formed in its upper surface 160. A correspondingly sized recess 162 is formed in a bottom surface 164 of base 142. Projection 158 has a flat base section 166 and a sloping sidewall 168. Spaced about the projection and protruding from the sidewall 168 are hemispherically shaped bosses 170. These hemispheres support surface 164 of base 142 so the base is raised above the upper surface of cover 150. Again this allows air to circulate between the base and cover and helps prevent scorching the surface on which the candle tin is placed.

What has been described is various embodiments of a candle tin which has a cover that normally fits over and closes a base in which a candle is formed or placed. The cover covers the open end of the base when the candle is not lit, and is removed when the candle is to be lit. When the cover is removed, it is placed on the surface supporting the candle tin. The cover can be placed face down or inverted depending upon the particular embodiment. The cover now supports the base of the candle tin and various constructions of the base and cover which facilitate this have been described. While the cover and base can have various colorations and decorative motifs incorporated in their construction or applied to their exterior surfaces, the function of the various constructions is to reduce heat transfer from the base to the cover so a surface upon which the candle tin is placed is not damaged. This is done by enabling air to flow about the base and cover or between them, as well providing a cover which comprises a large heat sink that absorbs the relatively small amount of heat which is transferred between the base and cover.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

I claim:

1. A candle tin comprising:

a hollow candle holder closed at one end in which a candle is disposed, the candle having a wick for the candle to burn when the wick is lit, the lit candle producing heat a portion of which is transferred through the holder to a surface upon which the candle tin is placed;

a cover sized to fit over the holder and removably placed over an open end of the holder to cover the candle when the candle is not lit, the cover, when removed, being placed upon the surface with the holder being set upon the cover for the cover to support the holder above the surface whereby the heat generated by the burning candle does not damage the surface, the holder and cover being cup shaped with the cover placed upon the surface open end down so a closed end of the cover supports the holder above the surface, a closed end of the holder being adjacent the closed end of the cover; and, protrusions formed on the closed end of the holder and extending therefrom, the protrusions resting upon the closed end of the cover to seat the holder on the cover.

2. The candle tin of claim 1 in which the closed end of the cover has a recess formed therein for seating the protrusions, there being a gap formed between the cover and holder when the holder is seated on the cover for air to flow between the cover and holder.

3. The candle tin of claim 1 wherein the closed end of the cover has a projection formed thereon and the closed end of the holder has a recess formed therein generally corresponding in size and shape to that of the projection.

4. The candle tin of claim 3 wherein bosses extend outwardly from said projection and a wall of said recess seats against the bosses to seat the holder on the cover.

5. A candle tin comprising:

a cup shaped holder in which a candle is disposed, the candle having a wick for the candle to burn when the wick is lit, the lit candle producing heat a portion of which is transferred through the holder to a surface upon which the candle tin is placed;

a cup shaped cover sized to fit over an open end of the holder and removably placed over the open end of the holder to cover the candle when the candle is not lit, the cover, when removed, being placed upon the surface and the holder being set upon the cover for the cover to support the holder above the surface whereby the heat generated by the burning candle does not damage the surface, the cover being placed upon the surface open end down for the closed end of the cover to support the holder above the surface; and, protrusions formed on the closed end of the holder and extending therefrom, the protrusions resting upon the closed end of the cover to seat the holder on the cover.

6. A candle tin comprising:

a cup shaped candle holder in which a candle is disposed, the candle having a wick for the candle to burn when the wick is lit, the lit candle producing heat a portion of which is transferred through the holder to a surface upon which the candle tin is placed;

a cup shaped cover sized to fit over the holder and removably placed over an open end of the holder to cover the candle when the candle is not lit, the cover, when removed, being placed upon the surface with the holder being set upon the cover for the cover to support the holder above the surface whereby the heat generated by the burning candle does not damage the surface, the cover being placed upon the surface closed end down and the holder including means engaging the cover at the cover's open for the holder to be supported above the surface; and, a plurality of spaced protrusions projecting outwardly from a sidewall of the holder, said protrusions contacting a sidewall of the cover adjacent the open end of the cover to seat the holder in the open end of the cover.

7. The candle tin of claim 6 wherein the sidewall of the cover has a first diameter generally corresponding to a diameter of the holder, and a second and larger diameter at the portion of the sidewall adjacent the open end of the cover, the protrusions contacting the larger diameter portion of the sidewall.

* * * * *